US006041847A

United States Patent [19]

Lai

[11] Patent Number: 6,041,847

[45] Date of Patent: Mar. 28, 2000

[54] BUILDING BLOCK FOR ROLLING SHUTTER

[75] Inventor: Man-Chi Lai, Aberdeen, The Hong Kong Special Administrative Region of the People's Republic of China

[73] Assignee: Wai-Man Lai, Aberdeen, The Hong Kong Special Administrative Region of the People's Republic of China

[21] Appl. No.: 09/149,202

[22] Filed: Sep. 8, 1998

[30] Foreign Application Priority Data

Sep. 11, 1997 [CN] China ..... 97222248

[51] Int. Cl.[7] ..... E06B 3/06

[52] U.S. Cl. ..... 160/236; 160/235

[58] Field of Search ..... 160/236, 232, 160/235, 133, 41; 52/102, 590.1, 590.2, 590.3, 592.1; 403/381, 375, 326, 294, 340, 339, 13, 14, 354, 364

[56] References Cited

U.S. PATENT DOCUMENTS

| | | | |
|---|---|---|---|
| 1,212,262 | 1/1917 | Rockwell | 403/381 |
| 2,520,221 | 8/1950 | Ponty | 403/381 X |
| 2,627,916 | 2/1953 | Hausam . | |
| 2,735,146 | 2/1956 | Purviance | 403/364 X |
| 2,858,582 | 11/1958 | Toulmin | 403/381 X |
| 3,425,721 | 2/1969 | Agee | 403/354 X |
| 3,480,054 | 11/1969 | Marian | 403/340 X |
| 4,019,298 | 4/1977 | Johnson | 403/381 X |
| 4,025,215 | 5/1977 | Murdock et al. | 403/381 X |
| 4,432,591 | 2/1984 | Rinkewich | 160/232 X |
| 5,247,773 | 9/1993 | Weir | 403/381 X |
| 5,412,918 | 5/1995 | Wendel et al. | 403/13 X |
| 5,424,118 | 6/1995 | McLaughlin | 52/588.1 X |
| 5,448,865 | 9/1995 | Palmerstein | 52/592.1 X |
| 5,502,939 | 4/1996 | Zadok et al. | 52/592.1 X |
| 5,507,335 | 4/1996 | Yu | 160/235 |
| 5,560,416 | 10/1996 | Yu | 160/235 X |
| 5,718,276 | 2/1998 | Rekret | 160/235 X |

FOREIGN PATENT DOCUMENTS 2177788Y 9/1994 China .

*Primary Examiner*—David M. Purol
*Attorney, Agent, or Firm*—Alix, Yale & Ristas, LLP

[57] ABSTRACT

The invention discloses a building block for rolling shutters which are use to shield and protect the door and windows of a shop. The blocks are made of plastic sheets, adopt new forms of engagements, and can be connected to form shutters of various sizes conveniently and optionally. The shutters made of this kind of plastic sheets overcome the disadvantage of vulnerability of metal shutters to rust, and are convenient to maintain, clean and replace any part thereof, and can prevent the penetration of rain water. When transparent plastic sheets are used to make the shutter blocks, people can see the exhibits behind the shutters to make the shutters not only have a theft-preventing function, but also achieve an advertising effect.

26 Claims, 8 Drawing Sheets

BUILDING BLOCK FOR ROLLING SHUTTER

FIELD OF THE INVENTION

This invention relates to a building block for a rolling shutter, particularly to a building block for rolling shutters which are used by shops.

BACKGROUND OF THE INVENTION

It is common for shops, when closed, to have their doors and windows shielded with metal shutters to prevent theft and robbery. Generally, the upper end of such a shutter is attached to the upper part of a door or a window and the lower end can be freely rolled up or unrolled. When shops are opened, the shutters are rolled up to have the doors and windows exposed. When shops are closed, the rolled-up shutters are unrolled and have their lower ends fixed. This kind of conventional shutters is composed of a plurality of building blocks made of iron, aluminum or steel. This kind of shutters has the disadvantages of being inconvenient to manufacture, transport and install. Also, when shutters are unrolled, people can not see the articles in shop windows through the shutters; if holes are made in shutter blocks, although the articles in shop windows can be seen, rain water can easily flow in through the holes when it is raining to wet down the doors and windows of the shop.

SUMMARY OF THE INVENTION

To overcome the disadvantages in prior art, the invention provides a building block for a rolling shutter made of plastic sheets. An integral shutter can be obtained by connecting a plurality of the shutter blocks in accordance with the invention.

An object of the invention is to provide new forms of mutual engagements by which shutter blocks can be conveniently and optionally connected to obtain shutters of different sizes.

Another object of the invention is to provide a shutter made of plastic sheets, which overcomes the vulnerability of metal shutters to rust, and is easy to maintain, clean and replace any part thereof.

Still another object of the invention is to provide a shutter made of transparent plastic sheets, which enables people to see the exhibits behind shutters. Therefore, the shutter of invention not only has the theft-preventing function, but also achieves an advertising effect.

Another object of the invention is to improve the waterproof performance of shutters to protect the shop windows for exhibiting articles.

To achieve the above objects, the building blocks for the rolling shutter of the intention are made of plastic sheets. Each block is retangular in shape. Its upper part is a protruded knot and its lower part is a split loop which is sized to exactly engage with the upper knot. The shapes of the two lateral ends of the shutter block also allow the two lateral ends to be connected by engaging with each other. Thus, by engaging the lower loop of a shutter block with the upper knot of another shutter block, and engaging its lateral ends with the other shutter block's lateral ends to have the shutter block connected upwards, downwards, leftwards and righwards, it is possible to optionally obtain shutters of different sizes easily and conveniently.

BRIEF DESCRIPTION OF THE DRAWINGS

The invention will be described in detail in connection with accompanying drawings, in which.

DETAILED DESCRIPTION OF THE PREFERRED EMBODIMENTS

Figure 1:
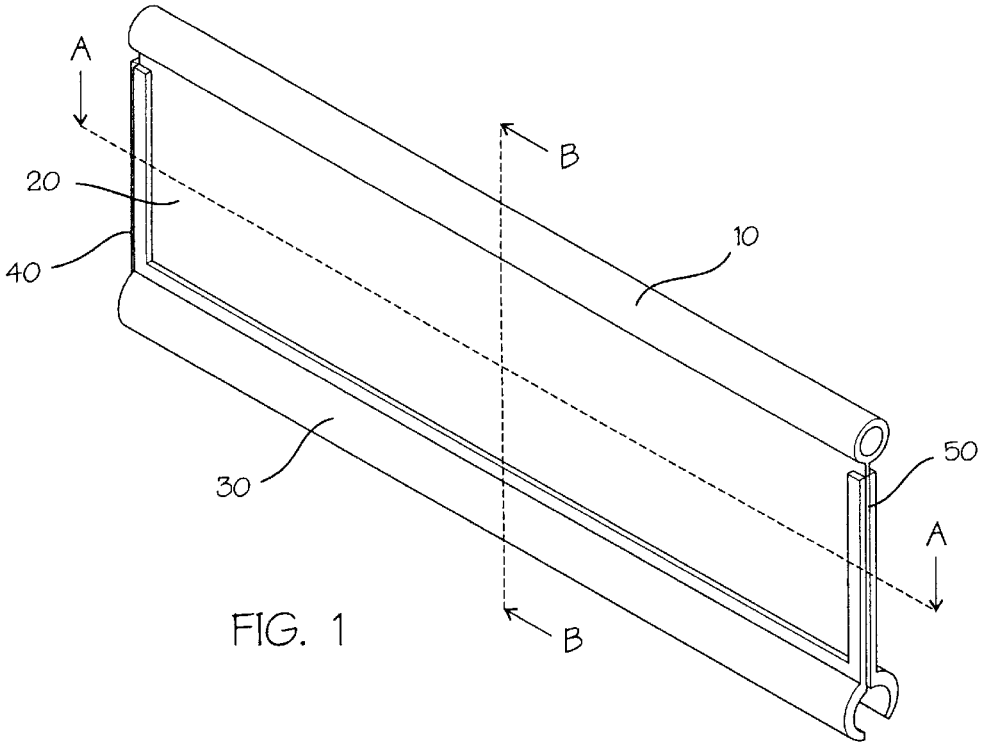
FIG. 1 is a perspective view of a shutter block in accordance with the invention.
Figure 2:
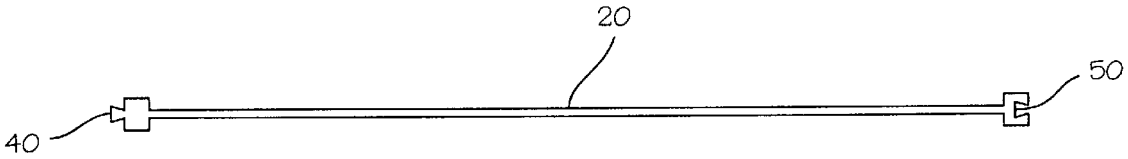
FIG. 2 is a sectional view of the shutter block taken along line A—A of FIG. 1, showing the shapes of the left and right lateral ends of a shutter block.

Next, referring to FIG. 1, the shutter block of a preferred embodiment in accordance with the invention is rectangular in shape. It comprises a protruded upper knot 10 at its upper end, a flat body 20 in the middle, and a split loop 30 at its lower end which can engage with the upper knot 10. On the left end of the shutter block there is a protrusion 40, and on the right side there is a recess 50 which can engage with the protrusion. When connecting two shutter blocks laterally, the left protrusion 40 of a block can be inserted into the right recess 50 of another block (refer to FIG. 2).

Figure 7:
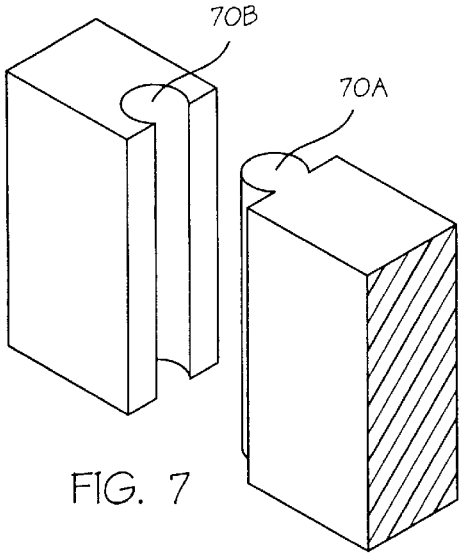
FIGS. 6–19 are perspective views showing alternative shapes of the lateral ends of the shutter block in accordance with the invention, illustrating the combinations of lateral ends with various shapes.
Figure 6:
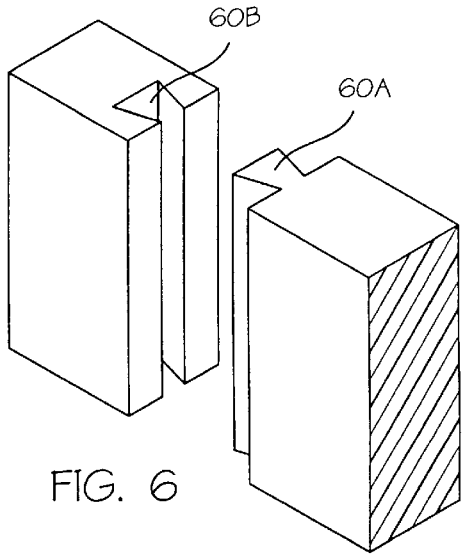
Figure 9:
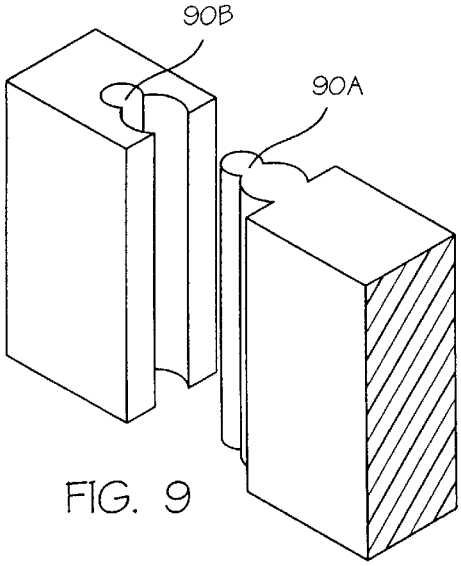
Figure 8:
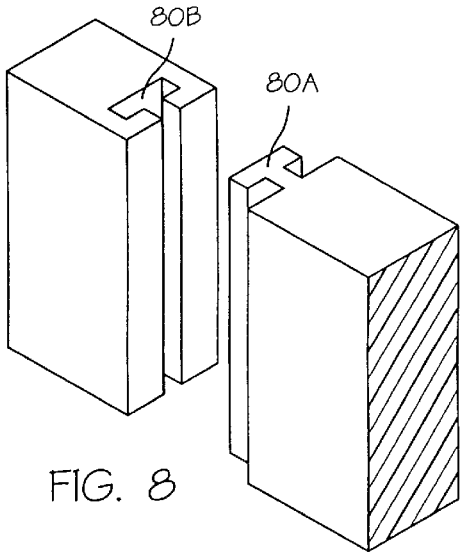
Figure 11:
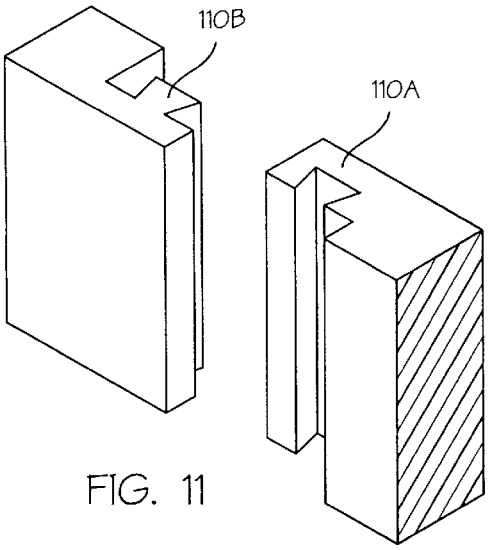
Figure 10:
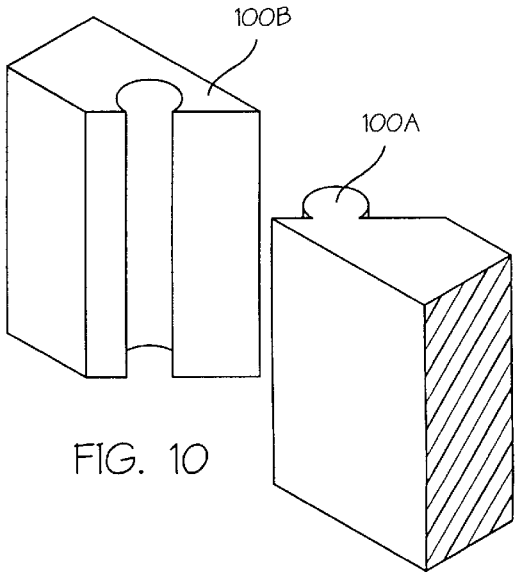
Figure 13:
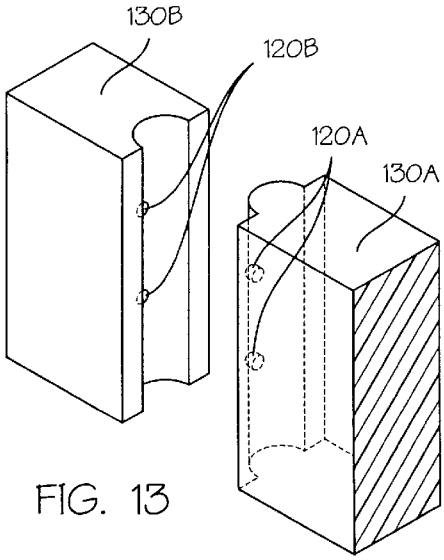
Figure 12:
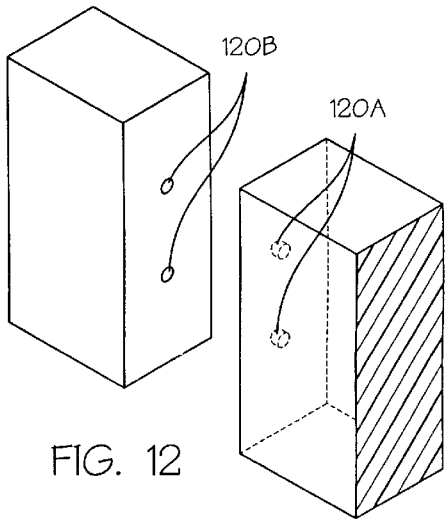
Figure 14:
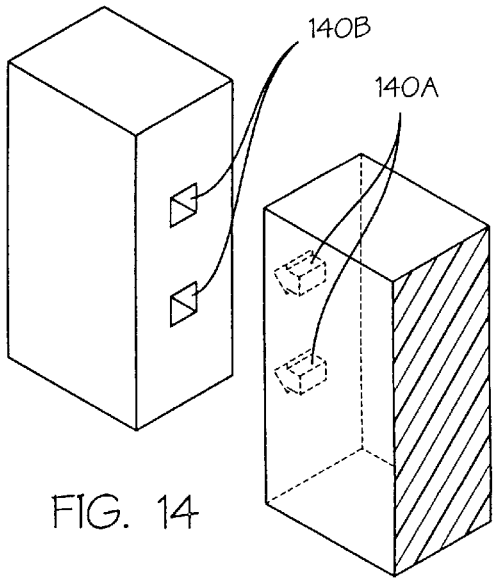
Figure 15:
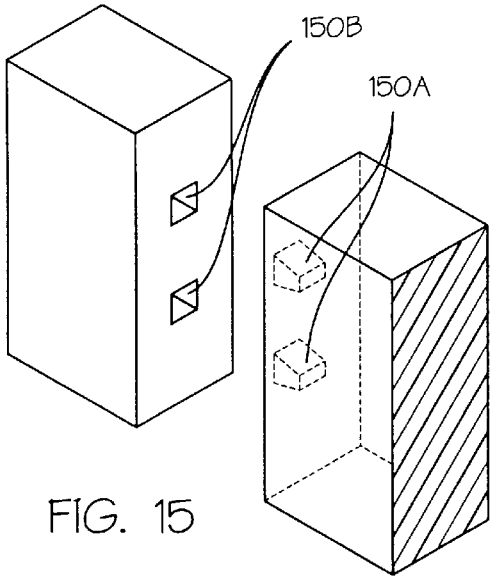
Figure 16:
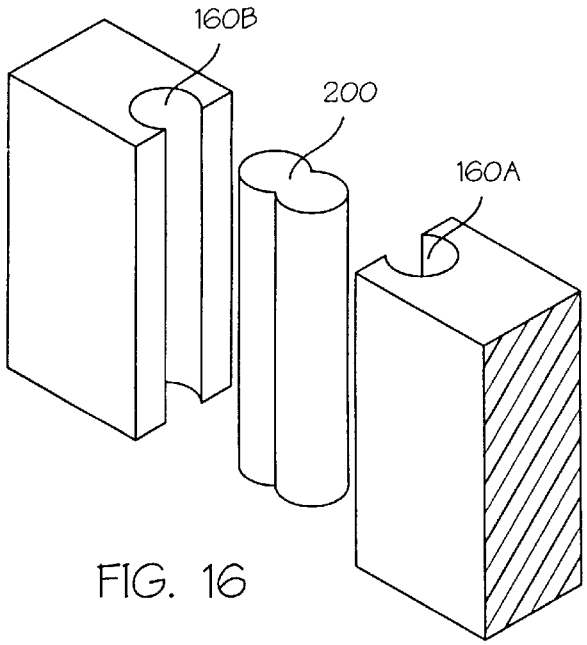
Figure 17:
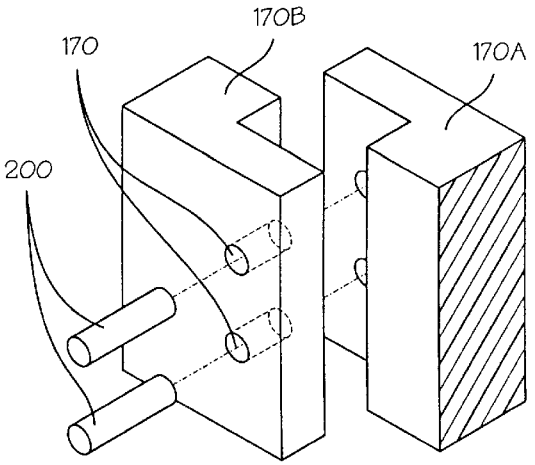
Figure 18:
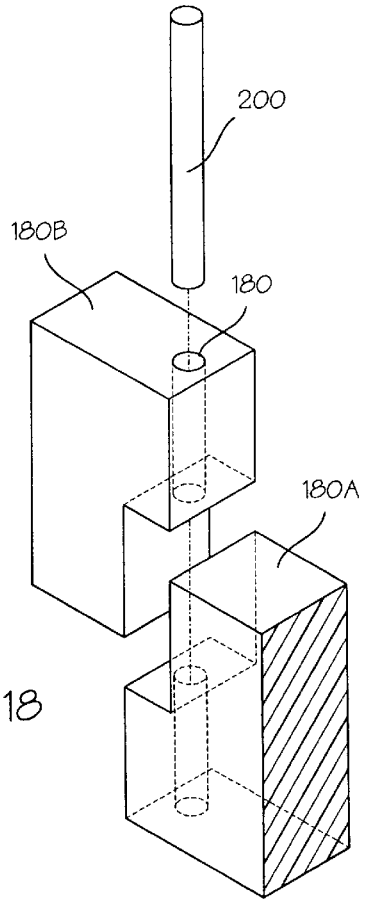
Figure 19:
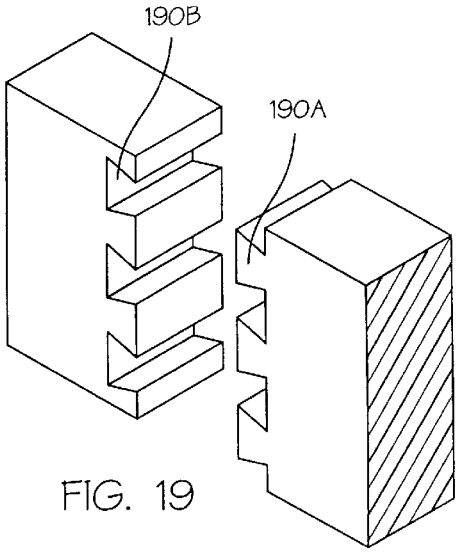
Figure 20:
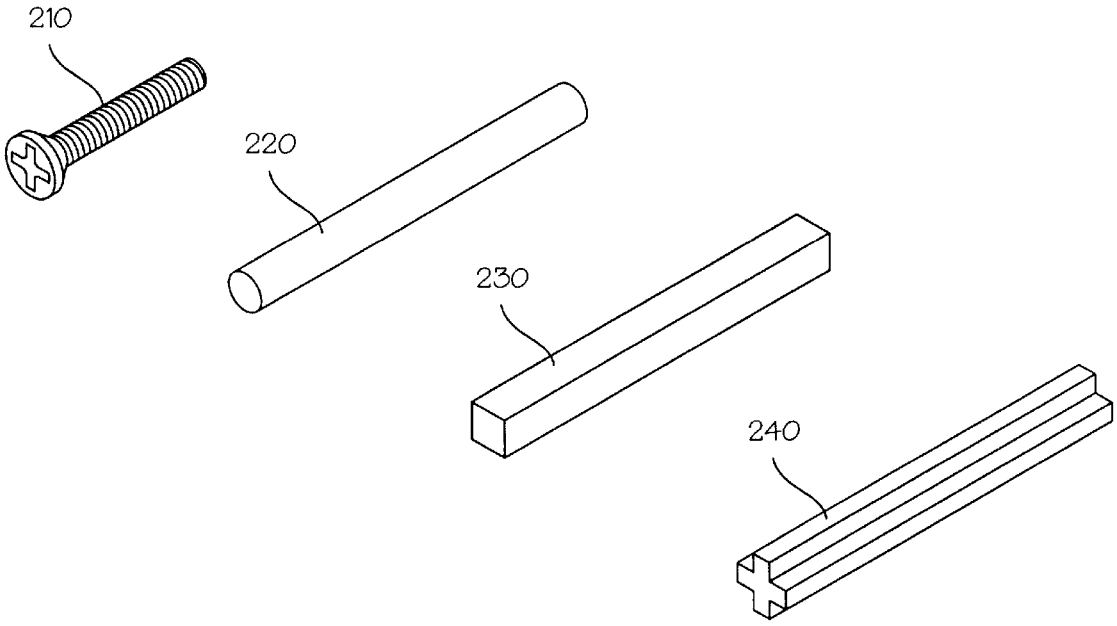
FIG. 20 are perspective views of the spikes in accordance with the invention, which are used for connecting the lateral ends of shutter blocks.

Also, the left and the right lateral ends can engage with each other in different ways. FIGS. 6–19 show the embodiments of the combinations of the lateral ends with the various shapes in accordance with invention. For example, FIG. 6 shows an engagement of a trapezoidal protrusion 60A and a trapezoidal recess 60B; FIG. 7 shows an engagement of a round protrusion 70A and a round recess 70B; FIG. 8 shows an engagement of a T-shape protrusion 80A and a T-shape recess 80B; FIG. 9 shows an engagement of a wave-shape protrusion 90A and a wave-shape recess 90B. The end faces of the lateral ends of a shutter block can also be of various shapes. For example, FIG. 10 shows the lateral ends with oblique faces 100A and 100B, and FIG. 11 shows the lateral ends with stepped faces 110A and 110B. Since the shutter blocks of the invention are made of plastic sheets having a slight flexibility, the lateral ends can be connected by way of snap fasteners. For example, FIG. 12 shows an engagement of a snap fastener type between 120A and 120B; FIG. 13 shows an engagement of a snap fastener type between the arcuate lateral ends 130A and 130B; FIG. 14 shows an engagement of a claw fastener type between 140A and 140B; and FIG. 15 shows an engagement of an insert fastener type between 150A and 150B. Some other ways of engagement of the lateral ends in accordance with the invention are shown in FIGS. 16–19. For example, FIG. 16 shows an engagement of a straight spike type, in which a spike 200 is inserted into the recesses 160A and 160B formed in the lateral ends of the shutter blocks to connect the shutter blocks laterally adjacent to each other; and FIG. 17 shows an engagement of a transverse spike type, in which the two ends 170A and 170B of the shutter blocks are transversely stepped and comprise transverse holes 170 for inserting spike 200; FIG. 18 shows an engagement of an upright spike type, in which two ends 180A and 180B of the shutter blocks are uprightly stepped and comprise uptight holes 180 for inserting spike 200. Spikes can be of various shapes such as screw shape 210, round rod shape 220, square rod shape 230 or crisscross rod shape 240 (refer to FIG. 20 ). FIG. 19 shows an engagement of a sawtooth type, in which the shutter block 1 has lateral ends of sawtooth profile 190A and 190B. Users can select various forms of engagements to connect the shutter blocks leftwards and rightwards.

Figure 21:
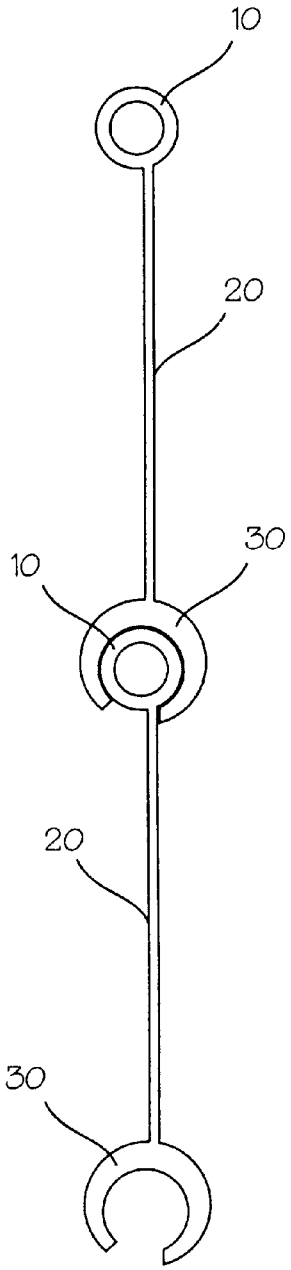
FIG. 21–23 are sectional views of the shutter block taken along line B—B of FIG. 1, showing the combinations of the upper knots and the lower loops with various shapes of the shutter blocks.
Figure 22:
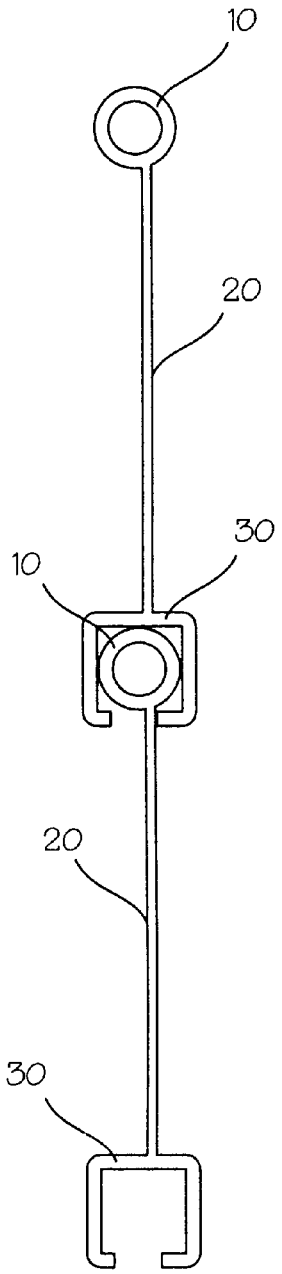
Figure 23:
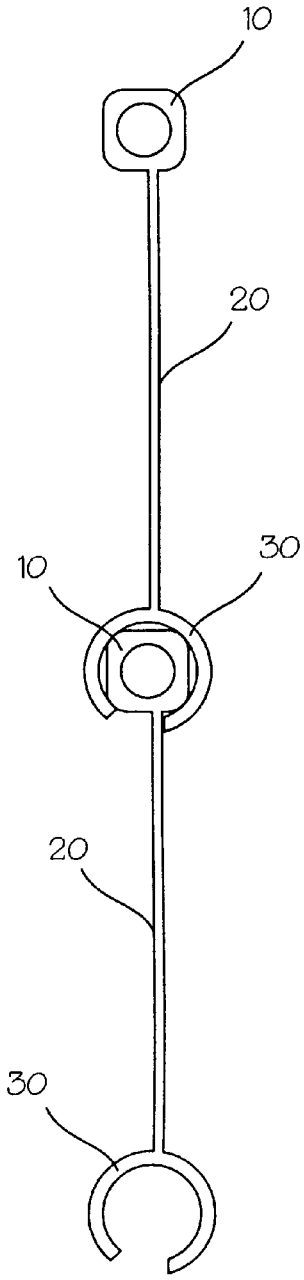

When connecting an upper shutter block to a lower one, the upper knot 10 of the lower shutter block is inserted into the lower loop 30 of the upper shutter block. The upper knot 10 and the lower loop 30 of block 1 may also have various forms of combinations. FIGS. 21–23 show the embodiments of various forms of combinations. For example, the upper knot 10 of the shutter block 1 can take the shape of a ring. Furthermore, an upper knot 10 and a lower loop 30 can be a combination of a polygon and a circle. Of course, if the upper knot 10 takes the shape of a polygon, preferably its corners are rounded to have a curvature which is larger than that of the circle of the lower loop 30 so as to enable the upper knot 10 to rotate within the lower loop 30.

Figure 3:
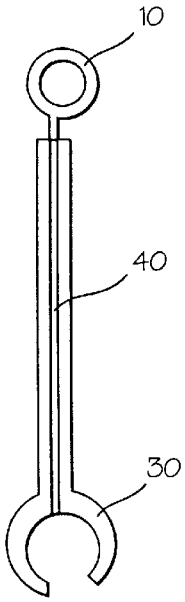
FIG. 3 is a left view of the shutter block in accordance with the invention.
Figure 4:
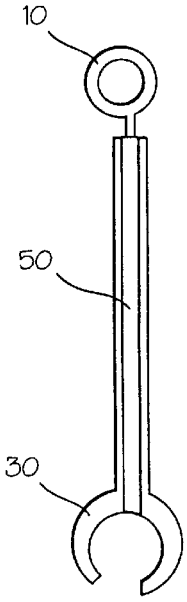
FIG. 4 is a right view of the shutter block in accordance with the invention.

In order to roll up a shutter when it is not used, the centers of both the upper protruded knot 10 and the lower split loop 30 are deviated from the body 20 of the shutter block, i.e., the centers are offset from the central transverse plane through the body 20 (refer to FIGS. 3 and 4)

Figure 5:
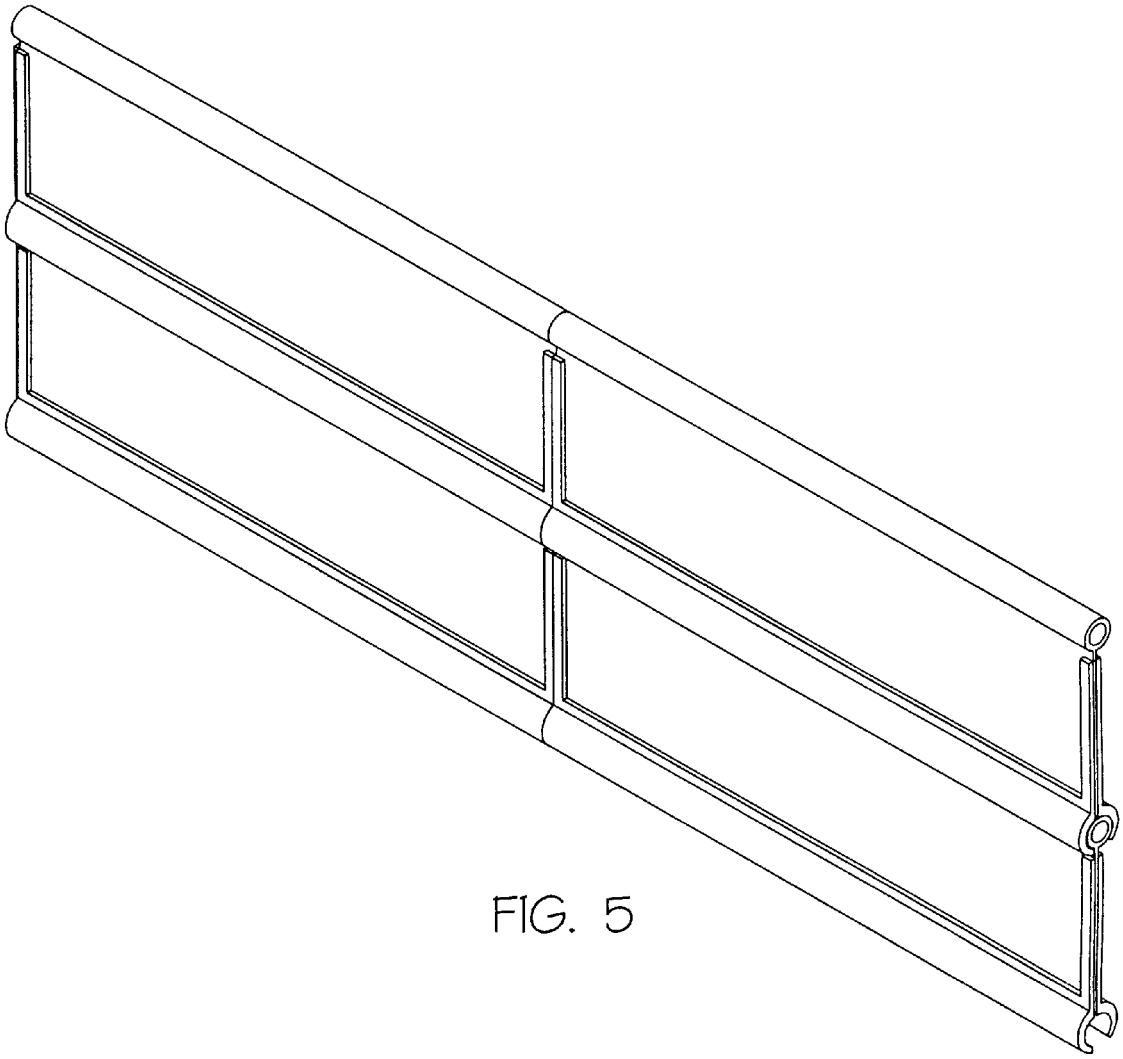
FIG. 5 is a perspective view showing a state when the shutter blocks of the invention are connected together.

Since the upper knot 10 of a block is sheathed with the lower loop 30 of an upper shutter block in accordance with the invention, when it is raining, rain water flows downward along one side so that it does not penetrate through any seams, thereby having a desirable water-proof effect When shutter blocks are connected together by engaging with each other, a complete shutter as shown in FIG. 5 is formed. Since this kind of shutter is made of plastic sheets having a little flexibility, it is advantageous to various forms of engagements: it is possible to connect the shutter blocks to obtain shutters of various sizes conveniently and optionally; the shutter is convenient to maintain, clean and replace any part thereof, and it overcomes the disadvantages of metal shutters in prior art the blocks of which can not engage tightly and are, vulnerable rust.

What is claimed is:

1. A building block for a rolling shutter, comprising longitudinally spaced first and second lateral sides, an upper knot, a block body, said block body defining a central transverse plane and a lower sit loop, wherein said knot and split loop extend substantially the entire length between said lateral sides and said lower split loop defines a slot forming an opening generally opposite said block body and extending substantially the entire length between said lateral sides and has an interior surface which is so sized and shaped as to engage with said upper knot, said knot having a neck portion sized for reception in said opening, and on said two lateral sides of said shutter block there are two lateral ends which can be connected by engaging with the lateral end of an adjacent building block, said knot and split loop defining central longitudinal axes offset from said transverse plane.

2. The shutter block as claimed in claim 1, wherein said shutter block is made of plastic sheet.

3. The shutter block as claimed in claim 2, wherein said shutter block is made of transparent plastic sheet.

4. The shutter block as claimed in claim 1, wherein said upper knot is a hollow cylinder, and said lower loop is a circular loop.

5. The shutter block as claimed in claim 1, wherein said upper knot is a hollow cylinder, and said lower loop is a polygonal loop.

6. The shutter block as claimed in claim 1, wherein said upper knot is a polygonal knot, and said lower loop is a circular loop.

7. The shutter block as claimed in claim 1, wherein one of said lateral ends of said shutter block comprises a protrusion having an end face, and the other comprises a recess having an end face, which can engage with said protrusion.

8. The shutter block as claimed in claim 7, wherein the end face with said protrusion and the end face of said recess of the shutter block are oblique faces.

9. The shutter block as claimed in claim 7, wherein the end face with said protrusion and the end face of said recess of the shutter block are stepped faces.

10. The shutter block as claimed in claim 7, wherein said protrusion and said recess of the shutter block are trapezoidal protrusions and trapezoidal recesses, respectively.

11. The shutter block as claimed in claim 7, wherein said protrusion and said recess of the shutter block are round protrusions and round recesses, respectively.

12. The shutter block as claimed in claim 7, wherein said protrusion and said recess of the shutter block are T-shape protrusions and T-shape recesses, respectively.

13. The shutter block as claimed in claim 7, wherein said protrusion and said recess of the shutter block are wave-shape protrusions and wave-shape recesses, respectively.

14. The shutter block as claimed in claim 1, wherein said lateral ends of the shutter block each comprise snap fasteners.

15. The shutter block as claimed in claim 14, wherein said two lateral ends with snap fasteners have round protrusions and round recesses formed thereon, respectively.

16. The shutter block as claimed in claim 1, wherein said two lateral ends each comprise claw fasteners.

17. The shutter block as claimed in claim 1, wherein said two lateral ends each comprise insert fasteners.

18. The shutter block as claimed in claim 1, further comprising a spike for connecting said lateral ends of the shutter block.

19. The shutter block as claimed in claim 18, wherein each of said two lateral ends of the shutter block comprises a recess for engaging with said spike.

20. The shutter block as claimed in claim 18, wherein said two lateral ends of the shutter block are transversely stepped lateral ends and have transverse holes for inserting said spike.

21. The shutter block as claimed in claim 18, wherein said two lateral ends of the shutter block are uprightly stepped lateral ends and have upright holes for inserting said spike.

22. The shutter block as claimed in claim 18, wherein said spike is a screw.

23. The shutter block as claimed in claim 18, wherein said spike is a round rod.

24. The shutter block as claimed in claim 18, wherein said spike is a square rod.

25. The shutter block as claimed in claim 18, wherein said spike is a crisscross rod.

26. The shutter block as claimed in claim 1, wherein said two lateral ends of the shutter block are saw-tooth lateral ends.

* * * * *

UNITED STATES PATENT AND TRADEMARK OFFICE

CERTIFICATE OF CORRECTION

PATENT NO. : 6,041,847
DATED : March 28, 2000
INVENTOR(S) : Lai

It is certified that error appears in the above-identified patent and that said Letters Patent is hereby corrected as shown below:

Column 3,
Line 49, change "sit" to -- split --.

Signed and Sealed this

Eighth Day of October, 2002

*Attest:*

*Attesting Officer*

JAMES E. ROGAN
*Director of the United States Patent and Trademark Office*